United States Patent [19]

Pitts

[11] Patent Number: 4,745,517

[45] Date of Patent: May 17, 1988

[54] MULTI-VECTOR DISCHARGE OF STATIC ELECTRICITY

[75] Inventor: Warren R. Pitts, Needham, Mass.

[73] Assignee: Dennison Manufacturing Company, Framingham, Mass.

[21] Appl. No.: 755,129

[22] Filed: Jul. 15, 1985

[51] Int. Cl.[4] ..... H05F 3/02

[52] U.S. Cl. ..... 361/212

[58] Field of Search ..... 361/212–220

[56] References Cited

U.S. PATENT DOCUMENTS

| | | | |
|---|---|---|---|
| 2,323,461 | 7/1943 | Donelson et al. | 361/220 X |
| 2,325,414 | 7/1943 | McChesney et al. | 361/220 |
| 2,378,623 | 6/1945 | Donelson et al. | 361/216 |
| 4,208,696 | 6/1980 | Lindsay et al. | 361/212 |
| 4,415,946 | 11/1983 | Pitts | 361/216 X |
| 4,586,106 | 4/1986 | Frazier | 361/212 |

*Primary Examiner*—L. T. Hix
*Assistant Examiner*—Brian W. Brown
*Attorney, Agent, or Firm*—George E. Kersey

[57] ABSTRACT

A lightweight anti-static panel electrically connected to a satellite pad. The panel comprises a cellulosic material impregnated with a conductive material. A grounding wire with a serial resistor connects the panel to an earth ground. The satellite pad is positioned at a convenient accessible location, for electrostatic discharge of a person or items.

17 Claims, 3 Drawing Sheets

MULTI-VECTOR DISCHARGE OF STATIC ELECTRICITY

BACKGROUND OF THE INVENTION

The present invention relates to the discharge of static electricity, and more particularly to moveable anti-static panels.

An electrically conductive web for discharging static electricity is shown in U.S. Pat. No. 4,208,696 to Lindsay. The web comprises a semi-conductive polymeric surface layer treated with one or more plasticizers and stabilizers, electrically connected to a foraminous layer, such as cotton scrim coated with carbon loaded resinous material. A grounding wire connects the web to an electrical ground.

Another type of anti-static surface is shown in U.S. Pat. No. 2,323,461. This surface comprises a conductive liquid or paste applied subjacent to a conventional floor covering, wherein conductive studs are distributed throughout the surface electrically coupling the conductive layer to the floor covering.

Each of these surfaces has the disadvantage of being expensive to manufacture. Further, the surface size is fixed, thus limiting repositioning or tailor fitting after construction. Moreover, static discharge is dependent on casual contact with the anti-static surface. In many applications, it would be inconvenient to deliberately induce static discharge.

It is therefore an object of the invention to provide a light weight, moveable, low cost, disposable, anti-static conducting surface.

It is an additional object of the invention to provide for easy and convenient electrostatic discharge of persons or items.

It is yet another object of the invention to provide an anti-static apparatus which is adjustable in size and shape, and which may easily be positioned in a wide variety of locations.

SUMMARY OF THE INVENTION

In accomplishing the foregoing and related objects, the invention provides an anti-static panel with one or more satellite pads.

In accordance with one aspect of the invention, a panel is provided comprising a cellulosic semi-conductive sheet impregnated with a conductive material, typically carbon particles. The sheet is lightweight and is thin, to avoid interference with work activities. In one embodiment the sheet is coated with a non-skid material, or has non-skid surfaces placed on its underside surface.

In accordance with a further aspect of the invention, a grounding wire is attached to the panel, for the purposes of conducting away static electricity. A connector is attached to the wire end, to facilitate connection to an earth ground.

In accordance with another aspect of the invention, a satellite pad is provided, sized smaller than the panel and electrically connected thereto by a grounding wire. The pad may be positioned at a convenient location, for touch discharge where the panel is inconveniently located or is inaccessible. In a preferred embodiment, the pad is provided with a two-sided adhesive backing, facilitating the positioning at convenient locations.

In accordance with yet another aspect of the invention, a resistor is provided serially connected to the panel grounding wire, to promote safe discharge.

BRIEF DESCRIPTION OF THE DRAWINGS

Other aspects of the invention will become apparent after considering several illustrative embodiments taken in conjunction with the drawings in which.

DETAILED DESCRIPTION OF THE INVENTION

Figure 1:
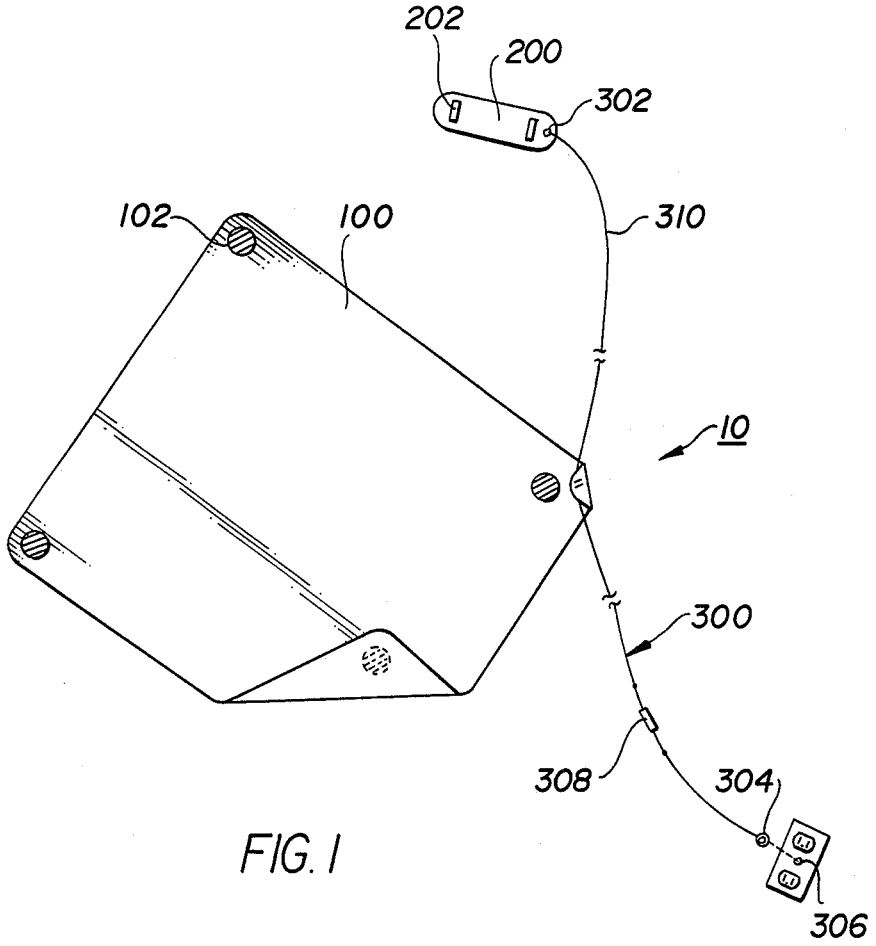
FIG. 1 is a perspective view of a panel, pad, current limiting resistor, and grounding wire in accordance with the invention, showing the panel and pad from the rear, with a corner of the panel folded over.

With reference to FIG. 1, the present invention 10 provides a thin, light-weight, grounded anti-static panel 100, having one or more electrically connected satellite pads 200. As shown in FIG. 1 the grounded anti-static panel 100 is non-superposed and displaced with respect to the electrically connected satellite pad 200.

Panel

In accordance with one embodiment of the invention, an anti-static panel 100 includes an electrically semi-conductive sheet, having a preferred resistivity in the range of $2.5\times10$ to the 5th Ohms per square (0.25 Megohms per square). The paper is preferably cellulosic, and is impregnated with carbon particles, or other conductive material. A variety of such cellulosic sheets, or papers, are commercially available, and may vary in color and type of conductive material. The paper is advantageously quite thin, to avoid interference with work activities. Particularly, thin paper is desirable where the mat will be placed under a typewriter or computer keyboard, wherein keyboard height is an important factor in operator comfort. In a preferred embodiment, the paper is 0.008 to 0.010 inches thick. A convenient size for many applications is 24 by 26 inches.

Adhesive Backing

The panel underside may be provided with a non-skid material on the side facing the work surface. In one embodiment, adhesive backed foam or rubber strips and or dots 102 are adhered to strategic locations on the panel. In another embodiment, the panel is coated, as by spraying or brushing, with a non-skid material. This provides the advantage of securely positioning the panel on the workplace, while enabling repositioning if desired. A non-skid feature is of particular importance where a component is placed on the panel. Due to the low weight of the panel, positioning on vertical surfaces, such as walls (FIG. 2), is easily accomplished, using two-sided adhesive tape, pins or other fastener.

Ground Strip and Prong

To dissipate the static electrical charge, a grounding wire 300 is advantageously attached to panel 100. For most applications, a small gauge wire may be used, for example, 18–22 gauge, insulated, stranded conductor. Attachment may be performed by a variety of methods, and is simply effectuated by metal staples 302 or metal snaps. Alternatively, the wire may be stapled into a folded edge of the panel for strain relief. It is important that a good wire/panel contact is established, so that electrical charge will be reliably conducted away. The free end of the grounding wire is provided with a grounding connector 304, such as a stake-type connector. In this manner, the wire is securely connected to an earth grounded element, such as grounding screw 306 which holds the receptacle plate on conventional 110 v outlets. Alternatively, if the device used in cooperation with the panel has a three-prong, grounded plug, the wire may be grounded to the device frame. In computer applications, however, outlet grounding is preferred to avoid the occurrence of stray electrical fields. A resistor 308 is serially connected between the panel, pads, and earth grounded element, to provide a total resistance to ground protection against a ground fault associated with nearby equipment, as well as the electrostatic discharge of persons. An eight megohm resistor, for example, has been found suitable for this purpose.

Satellite Pad

Figure 2:
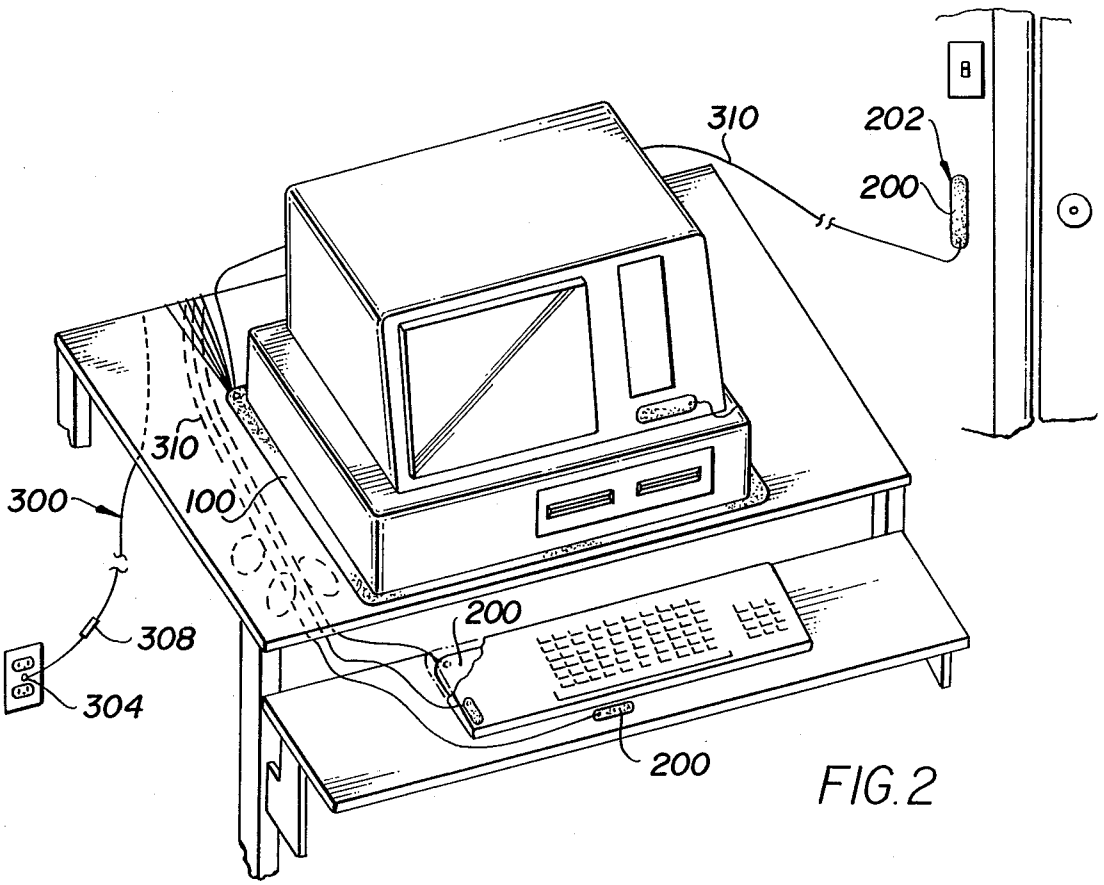
FIG. 2 is a perspective view of a panel showing a number of locations at which the panel and satellite pads may be positioned, including wall mounting of a pad.

In a preferred embodiment of the invention, a separate, electrically conductive satellite pad 200 is electrically connected to panel 100. Pad 200 is advantageously formed from the same material as panel 100, and has a grounding wire 310 similar to that provided for the panel. The pad serves as a convenient touch point for the discharging of static electricity. Access to the panel may frequently be obstructed by items positioned thereon such as a keyboard, or books and papers. As a result, it may be inconvenient for the user to discharge his body, or items, such as a diskette or cartridge, by contacting the panel. Thus, pad 200 may be located at a convenient point, such as at the side of the table, on the computer monitor, on the keyboard, or on the wall near an entrance. The pad may be provided with segments of two-sided adhesive material 202 wherein one side adheres to the pad, and the other side is adhered to a convenient mounting surface. More than one satellite pad may be provided as shown in FIG. 2, each having a flexible, insulated grounding wire extending to the panel at a common nodel point N, as above.

Satellite Pad Electrical Connection

The pad grounding wire 310 is electrically connected to the panel and pad. Preferably, the panel grounding wire 300 continuously extends, forming pad grounding wire 310, thus simplifying electrical connection to panel 100.

APPLICATIONS (F6)

The invention thus provides for improved anti-static grounding. The panel and satellite pad may be configured and positioned for convenient, effortless grounding, thereby avoiding incidence of uncomfortable shocks, as well as providing protection for important magnetically encoded data.

The panel may be cut with shears to fit beneath components, hidden from view. Alternatively, the panel may be cut to fit over keys or switches.

Figure 3:
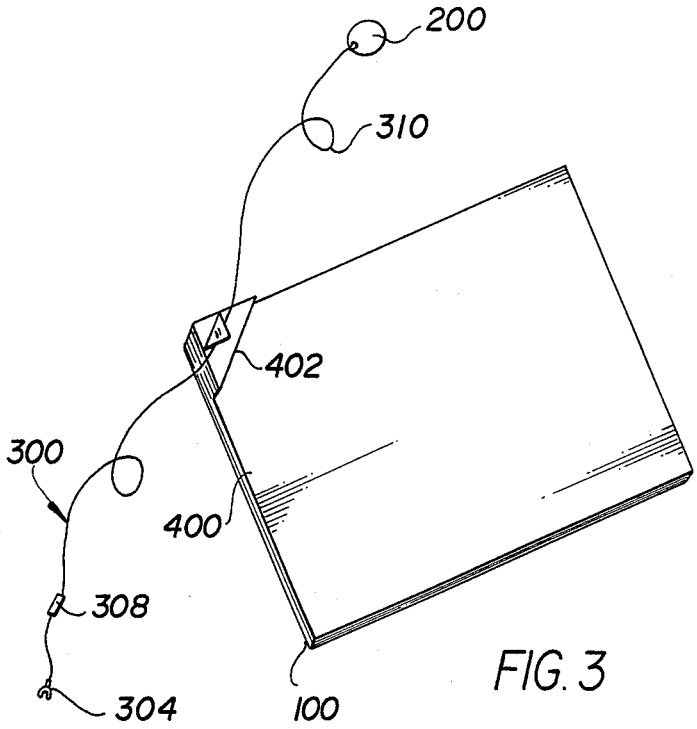
FIG. 3 is a perspective view of a perforated, multi-panel embodiment in accordance with the invention.

With reference to FIG. 3, a plurality of sheets 400 may be overlapped and fastened together, perforated along a common line 402. When upper sheets become worn or damaged, they are removed along the perforation, leaving the remaining sheets electrically connected to ground.

The satellite pads are positioned in a location which is easy for the user to touch. By positioning the pad on the keyboard monitor or wall, discharge is readily accomplished. A disadvantage of floormats is that a user wearing insulating shoes does not become adequately discharged. The pads provide a convenient touch point, wherein the user is discharged regardless of footwear type.

EXAMPLE

A panel in accordance with the invention, of 0.010 inches in thickness, connected to an 8 megohm resistor, and having a total resistance to ground of $2.5 \times 10$ to the 5th Ohms, was tested for electrostatic discharge. An individual was charged to 5 kilovolts, with a capacitance approximated as 200 picofarads. Thus, for a total system resistance of 10 to the 8th Ohms to ground, discharge time to less than 100 volts was approximately 1 second for 5 time constants.

While various aspects of the invention have been set forth by the drawings and the specification, it is to be understood that the foregoing detailed description is for illustration only and that various changes in parts, as well as the substitution of equivalent constituents for those shown and described, may be made without departng from the spirit and scope of the invention as set forth in the appended claims.

I claim:

1. Apparatus for the discharge of static electricity, comprising:

a plurality of semi-conductive sheets overlapped and fastened together, perforated along a common line;

a grounding wire electrically connecting said sheets to ground;

a resistor serially connected to said grounding wire;

whereby sheets are removed along the perforation, wherein remaining sheets are electrically connected to ground.

2. Apparatus of claim 1, wherein said resistor has a resistance of 8 megohms.

3. Apparatus of claim 1 wherein said semi-conductive sheets comprise a cellulosic material in sheet form.

4. Apparatus of claim 3, wherein said cellulosic material is less than or equal to 0.010 inches in thickness.

5. Apparatus of claim 1, wherein said semi-conductive sheets are 0.008 to 0.010 inches in thickness.

6. Apparatus of claim 4, wherein said cellulosic sheet is impregnated with carbon particles.

7. Apparatus of claim 1 wherein one of said semi-conductive sheets is provided with a non-adhesive non-skid surface.

8. Apparatus of claim 1, wherein one of said semi-conductive sheet is provided with an adhesive surface.

9. Apparatus of claim 1, wherein each semi-conductive sheets are provided with a non-skid surface.

10. Apparatus of claim 1, wherein said semi-conductive surfaces are provided with an adhesive surface.

11. Apparatus of claim 1, wherein a semi-conductive member is placed on an entry wall and is distinct and separate from the first semi-conductive member.

12. Apparatus as defined in claim 11 for the discharge of static electricity comprising:

a first of said semi-conductive sheets connected to a common nodal point;

a second semi-conductive member non-superposed and displaced with respect to said first sheet and connected to said common nodal point; and means for connecting said common nodal point to ground.

13. Apparatus as defined in claim 12 further including a third semi-conductive member non-superposed and displaced within respect to the other member, and connected to said common nodal point.

14. Apparatus as defined in claim 12 wherein the connections to said nodal point are integrally formed.

15. Apparatus as defined in claim 12 wherein the means for connecting said common nodal point to ground includes a resistor.

16. Apparatus as defined in claim 13 wherein a fourth semi-conductive member is connected to said nodal point.

17. Apparatus as defined in claim 12 wherein each semi-conductive member has a resistance of about $2.5 \times 10^5$ ohms.

* * * * *